US005860854A

United States Patent [19]

Sakoh et al.

[11] Patent Number: 5,860,854

[45] Date of Patent: Jan. 19, 1999

[54] BELT SANDER WITH A LATERAL DRIFT PREVENTION DEVICE

[75] Inventors: Masahiko Sakoh; Akihito Hara; Atsushi Utsuno, all of Anjo, Japan

[73] Assignee: Makita Corporation, Anjo, Japan

[21] Appl. No.: 759,577

[22] Filed: Dec. 5, 1996

[30] Foreign Application Priority Data

Dec. 6, 1995 [JP] Japan ..... 7-318324

[51] Int. Cl.[6] ..... B24B 21/20

[52] U.S. Cl. ..... 451/297; 451/355

[58] Field of Search ..... 451/296, 297, 451/355; 474/101, 111, 119, 122, 123, 133, 134, 102, 107, 103; 198/840; 226/23

[56] References Cited

U.S. PATENT DOCUMENTS

| | | | |
|---|---|---|---|
| 2,565,223 | 8/1951 | Gentzel | 451/297 |
| 3,029,568 | 4/1962 | Lubas . | |
| 3,497,336 | 2/1970 | Buschman . | |
| 4,115,957 | 9/1978 | Porth et al. . | |
| 4,177,609 | 12/1979 | Rameckers et al. | 451/297 X |
| 4,335,542 | 6/1982 | Howe | 451/297 X |
| 4,337,598 | 7/1982 | Barth et al. | 451/297 X |
| 4,574,531 | 3/1986 | McCurry | 451/297 X |
| 4,896,462 | 1/1990 | Farmerie . | |
| 5,184,424 | 2/1993 | Miller | 451/297 |
| 5,273,493 | 12/1993 | Felici | 451/297 X |
| 5,319,887 | 6/1994 | Walz et al. . | |

FOREIGN PATENT DOCUMENTS

| | | | |
|---|---|---|---|
| 2014134 | 10/1970 | Germany | 451/297 |
| 2920393 | 11/1980 | Germany | 451/297 |
| 6-27326 | 7/1994 | Japan . | |
| 6-34927 | 9/1994 | Japan . | |
| 514137 | 5/1976 | U.S.S.R. | 451/297 |

*Primary Examiner*—Timothy V. Eley
*Attorney, Agent, or Firm*—Lahive & Cockfield, LLP

[57] ABSTRACT

A belt drift control device (20) is mounted in the side wall (2*a*) of belt sander (1) comprises a shoulder bolt (22) threaded through a nut 21 in the side wall (2*a*). A generally conical, tapered roller (23) is rotatably engaged with the free end of the shoulder bolt (22). The tapered roller (23) comprises a taper portion (24) and a flange (24*a*). The axial movement of the tapered roller (23) is restricted by a washer (26) and a stop ring (27). A control knob (29) is fitted around the head of the shoulder bolt (22) and pressed outwardly by a compression spring (28) surrounding the shoulder bolt (22). Rotation of the control knob (29) axially feeds the shoulder bolt (22) to permit adjustment of the position of the tapered roller (23) relative to an abrasive belt (10). The tapered roller (23) is preferably positioned such that the top end of the taper portion (24) is in contact with the left edge (10*a*) of the abrasive belt (10) when the belt (10) is a normal position.

25 Claims, 5 Drawing Sheets

BELT SANDER WITH A LATERAL DRIFT PREVENTION DEVICE

BACKGROUND OF THE INVENTION

1. Field of the Invention

The present invention relates to a belt sander having an endless abrasive belt trained over a pair of rollers. More particularly, the present invention relates to a device to prevent lateral drift of the abrasive belt for use in such a belt sander.

2. Description of the Prior Art

The abrasive belt of a typical sander is subject to lateral shifting during operation due to the undesirable inclination of one of the two rollers over which the belt is trained and also due to the manufacturing variations in the belt structure itself, such as the difference between the right and left circumferential lengths.

Various devices have been proposed to eliminate this problem: Japan Published Examined Utility Model Application No. H6-34927 discloses a device in which a yoke for mounting one of the belt rollers is pressed toward a frame via steel balls by compression springs and adjusting screws in order to secure the roller in a predetermined position. This prevents the undesirable inclination of the roller that causes its lateral drift. Meanwhile, Japan Published Examined Utility Model Application No. H6-27326 discloses an improved control nut threaded into the shaft of one of the belt rollers so that, by rotating the nut, the inclination of the roller can be adjusted according to the lateral drift of the belt. This improved nut is designed so as not to be loosened by the vibration of the belt sander, thus maintaining the correct inclination of the roller at which the abrasive belt does not drift laterally.

These devices, however, have poor operability in that they require manual adjustment by the operator: in the first device, the operator needs to remove the abrasive belt and rotate the screws for proper adjustment; in the latter, the control nut needs to be also rotated each time a new belt is installed.

SUMMARY OF THE INVENTION

In view of the above-identified problems, an object of the present invention is to provide an improved belt sander which can automatically correct lateral drift of the abrasive belt.

Another object of the present invention is to provide an improved belt sander with improved operability by eliminating the need for manual adjustment to prevent lateral drift of the abrasive belt.

The above and other related objects are attained by the invention, which provides a belt sander comprising, a pair of driving and driven rollers, an endless abrasive belt trained over the driving and driven rollers, a motor for rotatably driving the driving roller and the abrasive belt, and a belt biasing means disposed adjacent to a side edge of the abrasive belt where the belt is free of the roller. The belt biasing means, responsive to lateral drift of the abrasive belt, comes into contact with the underside of the abrasive belt close to the side edge and biases the side edge of the abrasive belt in the direction of the top surface of the abrasive belt.

Preferably, the belt biasing means comprises a slide contact member having a slope obliquely extended in the direction of the top surface of the abrasive belt away from the center of the abrasive belt, so that the side edge of the abrasive belt comes into contact with the slide contact member when the abrasive belt drifts laterally. More specifically, the slide contact member may have a generally conical, tapered portion for a maximum effect.

Furthermore, the belt biasing means may comprises a means for adjusting the position of the slide contact member relative to the abrasive belt, such as a bolt and a nut engaged with the bolt.

In carrying out the invention in one preferred mode, the belt biasing means comprises a seesaw-like member rotatably supported in an intermediate portion thereof having on one end an abutment portion for rotating toward the underside of the abrasive belt when the side edge of the laterally drifting belt abuts the abutment portion, and on the other end a push-up portion for rotating toward the top surface of the abrasive belt and biasing the abrasive belt responsive to the rotation of the abutment portion toward the underside of the abrasive belt. The push-up portion may include a rotatable member for coming into contact with the underside of the abrasive belt and rotating in the same direction as the abrasive belt when the abutment portion rotates toward the underside of the belt. The rotatable member may be any one of a roller, a ball, and a generally conical, tapered roller.

In another preferred mode of the present invention, the belt biasing means comprises an arm pivotally supported on one end thereof. The arm has on the other end an abutment portion against which the abrasive belt abuts when drifting laterally. The pivotal arm also has an initial contact member so positioned thereon as to be in contact with the side edge of the abrasive belt when the abrasive belt is in a normal position. With this construction, the arm pivots outward upon abutment of the side edge of the abrasive belt against the abutment portion, thus bringing the initial contact member into contact with the underside of the abrasive belt. Preferably, the initial contact member includes a generally conical, tapered portion.

If possible, the belt biasing means should be positioned adjacent to one of the driving or driven rollers at a point where the abrasive belt is free of the roller but is about to be rolled over the roller.

A belt sander in accordance with the invention may further comprises a means for laterally inclining the one of the driving or driven roller that is closer to the belt biasing means so as to cause the abrasive belt to drift laterally. This construction allows the belt to drift to one side only.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

Embodiment 1

Figure 1:
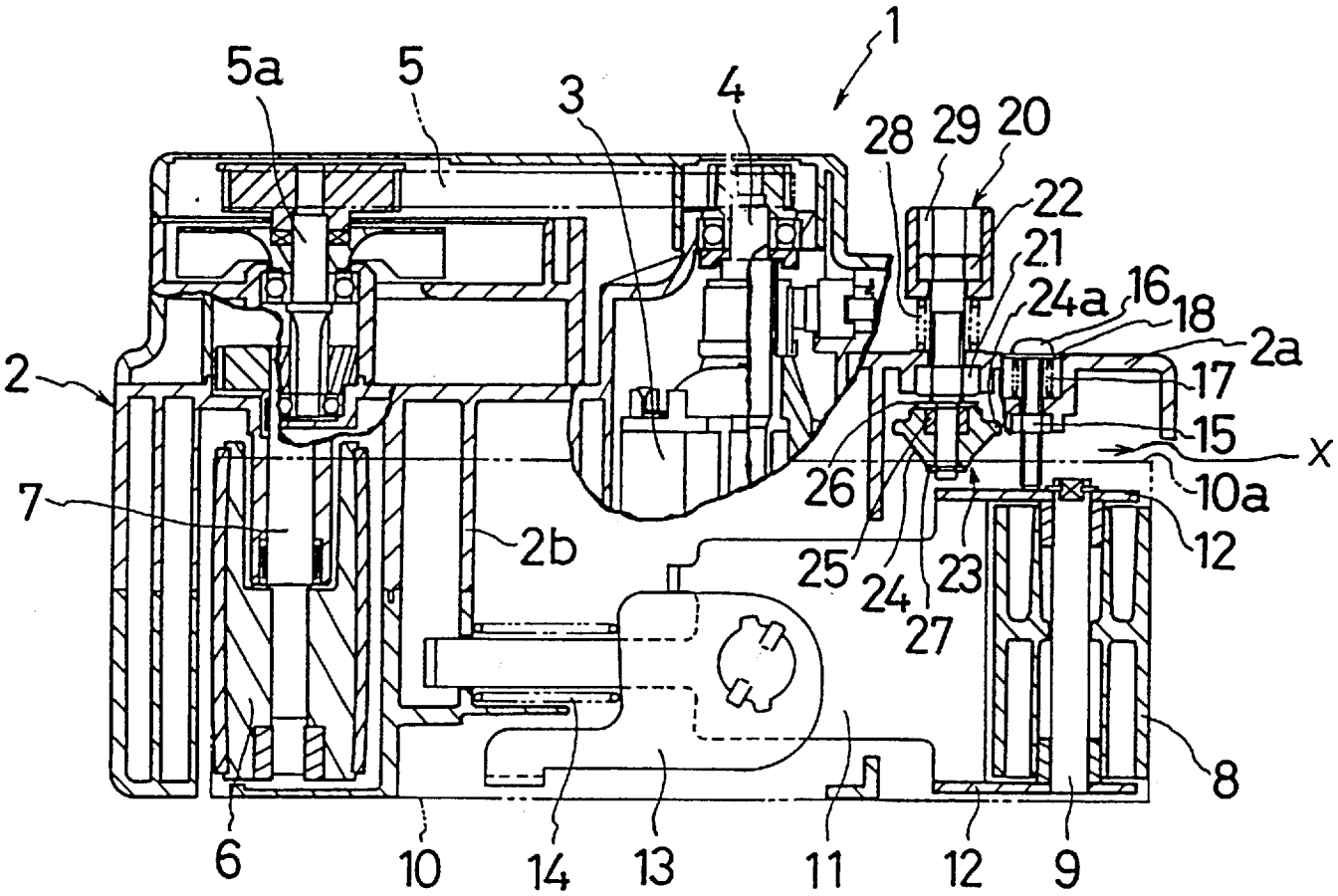
FIG. 1 is a partially cutaway, partially sectional plan view of a belt sander in accordance with the present invention.
Figure 2:
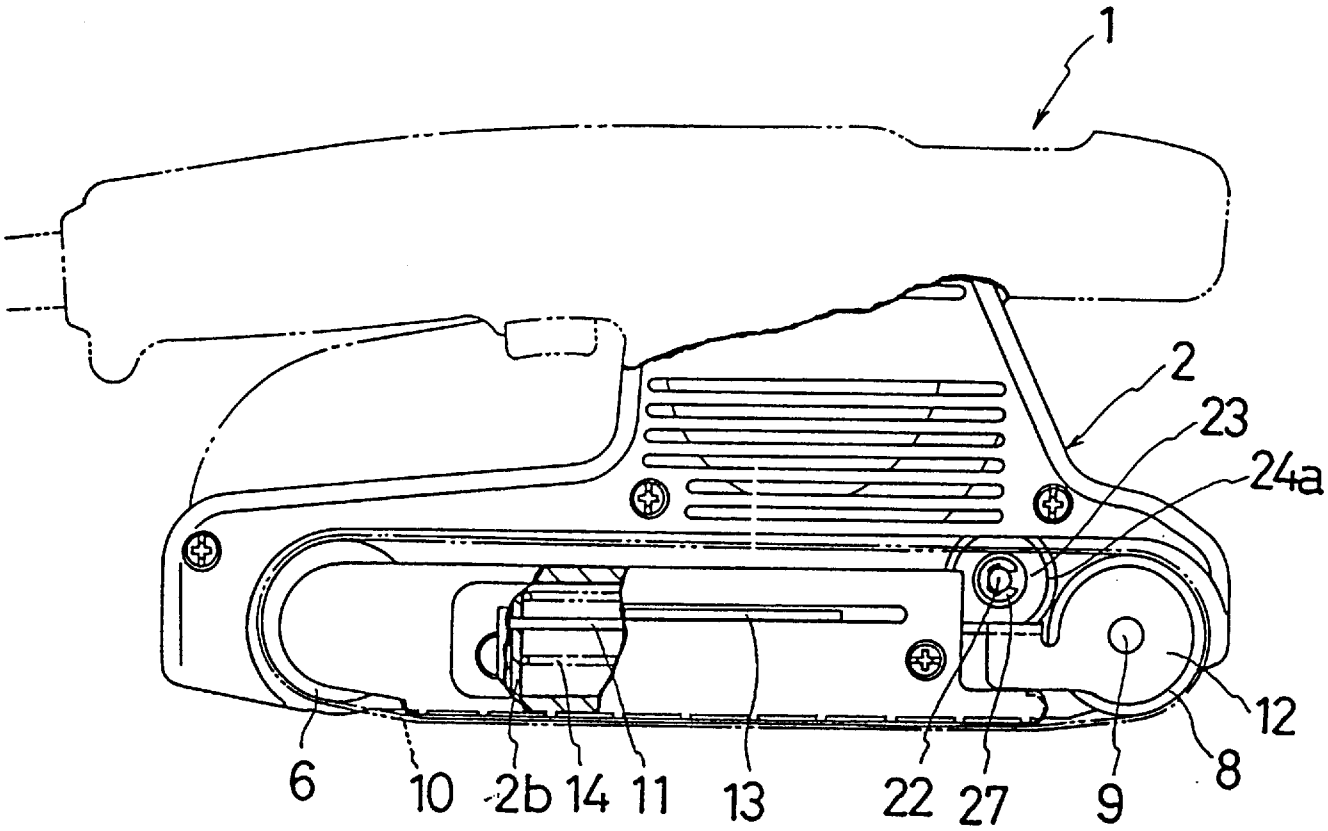
FIG. 2 is a partially sectional side elevation of the belt sander shown in FIG. 1.

Referring to FIGS. 1 and 2, numeral 1 generally designates a belt sander comprising a housing 2 enclosing a motor 3 over an endless abrasive belt 10. The rotation of the motor 3 is transmitted from a motor shaft 4 via a belt 5 to the gear of an intermediate shaft 5*a* located below the motor 3. The intermediate shaft 5*a* is engaged with the gear of a roller shaft 7 of a driving roller 6 for rotating the driving roller 6. A driven roller 8 is disposed in front of (on the right as seen in FIGS. 1 and 2), and in parallel to, the driving roller 6. The abrasive belt 10, trained over the two rollers 6 and 8, is rotated in the direction indicated by the arrow X shown in FIGS. 1 and 5.

The driven roller 8 includes a roller shaft 9 secured on both ends to a pair of support arms 12 extended forward from a support plate 11 which is slidably accommodated within the housing 2. The support plate 11 has a lever 13 rotatably mounted behind the support arms 12 and also has a narrow portion extended rearward through a partition 2*b* of the housing 2. A compression spring 14 surrounds the narrow portion between the partition 2*b* and the lever 13. The spring 14 can be either compressed or released by rotating the lever 13 in order to press forward the support plate 11 and the driven roller 8 or to take the spring tension off the plate 11 and the roller 8, thus permitting replacement of the belt 10.

One of the support arms 12 of the driven roller 8 is abutted by the top end of an adjustment screw 16 which is threadingly engaged with a nut 15 secured to a side wall 2*a* of the housing 2. By its manual rotation, the screw 16 can extend or retract in the axial direction to adjust the position of the driven roller 8 relative to the driving roller 6. In this example, the screw 16 is so adjusted as to slightly incline the driven roller 8 to the left toward the adjustment screw 16 so that the abrasive belt 10, when rotated, moves to the left. Reference numeral 17 designates another compression spring urging the adjustment screw 16 and a washer 18 away from the side wall 2*a*.

Figure 5:
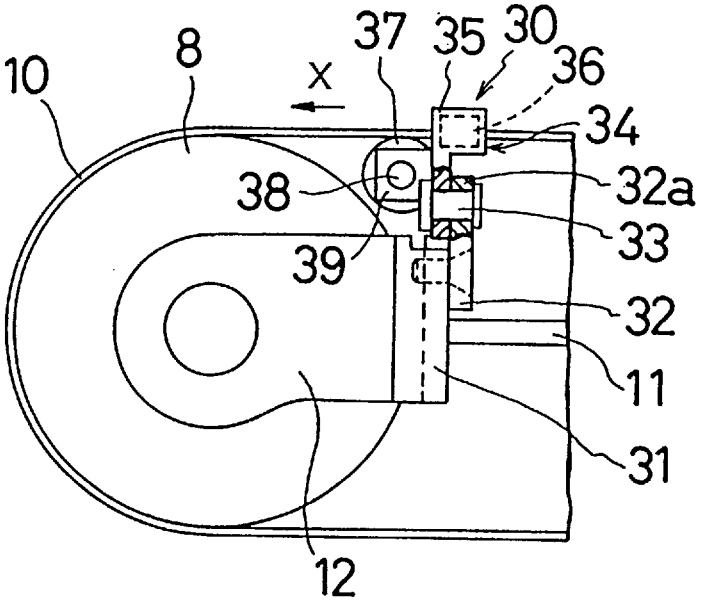
FIG. 5 is a side elevation of a control device of another preferred embodiment in accordance with the present invention.

Also mounted in the side wall 2*a* slightly behind the driven roller 8 is a belt drift control device 20. The control device 20 includes a shoulder bolt 22 threaded through a fixed nut 21 integral with the side wall 2*a*. A generally conical, tapered roller 23 is rotatably engaged with the free end of the shoulder bolt 22 via an oilless bearing 25. The tapered roller 23 comprises a taper portion 24 with its diameter increasing away from the driven roller 8. A flange 24*a* is formed on the larger-diameter edge of the taper portion 24 for preventing the abrasive belt 10 from traveling over the tapered roller 23. The axial movement of the tapered roller 23 is prevented by a washer 26 and a stop ring 27 mounted around the shoulder bolt 22. A control knob 29 is fitted around the head of the shoulder bolt 22 and pressed outwardly by a compression spring 28 surrounding the shoulder bolt 22. Rotation of the control knob 29 axially feeds the shoulder bolt 22 to adjust the position of the tapered roller 23 relative to the abrasive belt 10. FIGS. 1 and 5 show that the tapered roller 23 is positioned such that the top end of the taper portion 24 is in contact with the left edge 10*a* of the abrasive belt 10.

Figure 3:
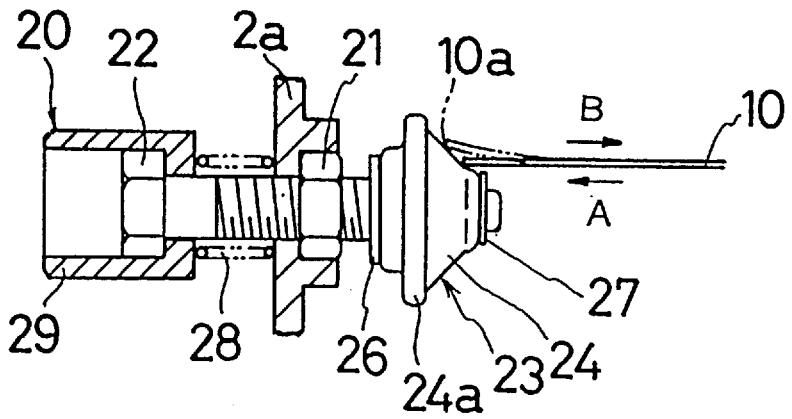
FIG. 3 is a partially sectional side elevation of a control device of one preferred embodiment in accordance with the present invention.
Figure 4:
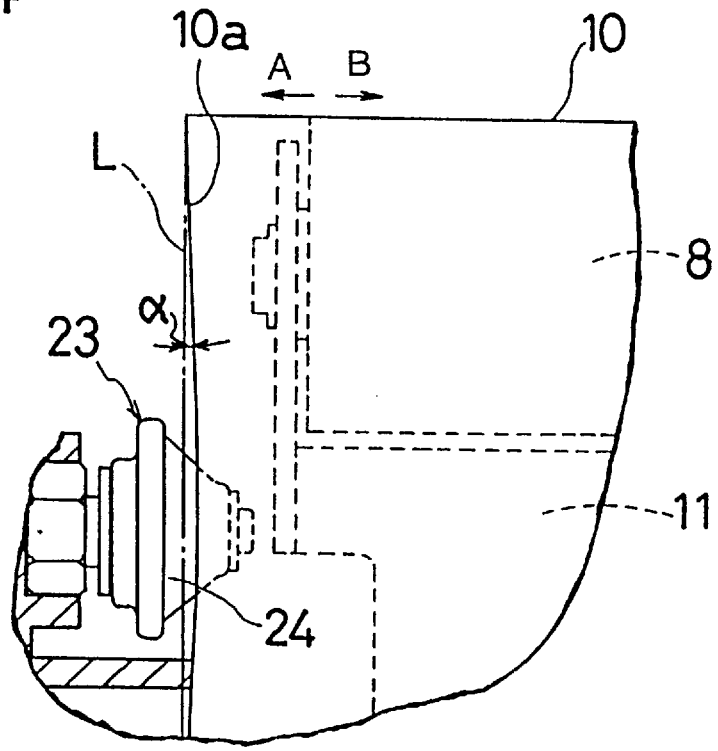
FIG. 4 is a plan view illustrating the operation of the control device shown in FIG. 3.

In the operation of the belt sander thus constructed, the abrasive belt 10 travels in the direction indicated by arrow X upon actuation of the motor 3. The circulating abrasive belt 10 drifts toward the tapered roller 23 (as indicated by the arrow A shown in FIGS. 3 and 4) with the driven roller 8 inclined toward the left by the adjustment screw 16 as previously explained. The taper portion 24, as it is abutted by the left edge 10*a* of the abrasive belt 10, limits further lateral drift of the abrasive belt 10 in direction A. If a greater force is exerted on the abrasive belt 10 to move farther in direction A due to a manufacturing error in the belt, the abrasive belt 10 travels over the taper portion 24 with the edge 10*a* lifted upward as shown by the phantom line in FIG. 3. This creates a force acting on the abrasive belt 10 to move back in the direction indicated by the arrow B in FIGS. 3 and 4. Consequently, the abrasive belt 10 stops drifting at the point where the forces acting in directions A and B reach an equilibrium and holds its position. The force exerted in direction B occurs because the edge 10*a* of the abrasive belt 10, as it travels over the taper portion 24, becomes inclined from its normal position L toward the opposite edge by the angle $\alpha$ as shown in FIG. 4. This creates the same effect as when the driven roller 8 is inclined toward the right by angle $\alpha$, thus creating the force acting in direction B. The contact surface of the taper portion 24 is inclined upward and extends away from the edge 10*a* and above the top, abrasive face (inclined upward away from the center of the belt 10).

Accordingly, the greater the force exerted in direction A grows, the further up on the taper portion 24 the abrasive belt 10 travels, thus increasing angle $\alpha$. As a result, the force exerted in direction B also increases in proportion until an equilibrium is reached.

According to the belt sander of this embodiment, the tapered roller 23 of the control device 20 automatically prevents the lateral drift of the abrasive belt 10 and maintains the belt 10 in a fixed lateral position as described above. Once the position of the tapered roller 23 is set by rotating the control knob 29, the same drift prevention function of the control device 20 remains effective with no further adjustment even after the abrasive belt 10 is replaced. This minimizes the need for the bothersome adjustments as required in conventional belt sanders following each belt replacement, thereby enhancing the operability of the machine.

The tapered roller 23 of this embodiment has the preferred shape for coming into contact with the edge of the abrasive belt 10 because it causes minimal wear of the belt 10. However, an axially halved tapered roller, or an inclined plate with a flat or curved surface may also suffice to obtain the desired effect.

Embodiment 2

Another preferred embodiment of the present invention will be explained hereinafter. Like reference characters designates like or corresponding parts throughout the drawings, so that the description thereof is hereby dispensed with.

Figure 6:
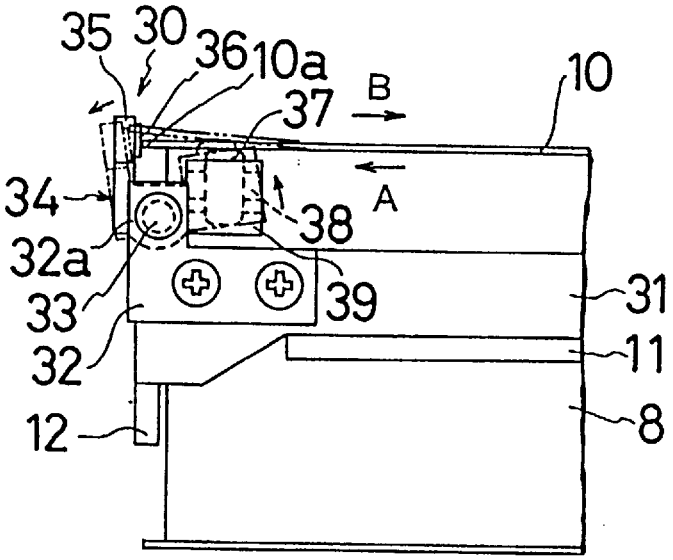
FIG. 6 is an elevation view of the control device shown in FIG. 5.

With reference to FIGS. 5 and 6, numeral 30 generally designates a control device provided on the support plate 11. The arms 12 supporting the driven roller 8 are connected with each other by a rear plate 31 to which a base 32 of the control device 30 is secured by screws. The base 32 has on its upper end a lug 32*a* on which the intermediate portion of a rocking arm 34 is pivotally supported by a pin 33. The upright end of the rocking arm 34 is formed as an abutment plate 35 whose inner surface is extended close to the edge 10*a* in parallel with the rotational direction X of the abrasive belt 10. A ceramic plate 36 is mounted on the same side of the abutment plate 35 as the edge 10*a* and, when the belt sander 1 is assembled, comes into contact with the edge 10*a*.

The plate 36 may be made of a carbide chip instead of ceramic. The other end of the rocking arm 34 is disposed under the upper passage of the abrasive belt 10 and has a push-up 39. An underside roller 37 is supported by the push-up 39 via a roller pin 38 so as to rotate in the same direction as the abrasive belt 10. As the push-up 39 and underside roller 37 are heavier than the abutment plate 35 and the ceramic plate 36, the abutment plate 35 is tipped toward the abrasive belt 10 to keep the ceramic plate 36 in contact with the edge 10*a*.

In the operation of the control device 30 thus constructed, when the abrasive belt 10 travels in direction A due to the initial leftward inclination of the driven roller as explained in the first embodiment, the belt 10 travels in direction A, bringing the edge 10*a* into contact with, and outwardly pushing the abutment plate 35. Then, as shown by the phantom line in FIG. 6, the rocking arm 34 pivots counterclockwise on the pin 30, while shifting the push-up 39 toward the top surface of the belt 10.

Concurrently, the underside roller 37 pushes up the edge 10*a* in the direction of the surface of the belt 10, thus creating a force acting on the belt 10 to move back in direction B as in the first embodiment. Likewise, the abrasive belt 10 stops drifting at the point where the forces acting in directions A and B reach an equilibrium and holds its position. If the abrasive belt 10 moves in direction B, the rocking arm 34 pivots clockwise, maintaining the contact of the ceramic plate 36 with the edge 10*a*. As in the first embodiment, the farther in direction A the belt 10 travels, the farther up the push-up 39 is shifted, thus increasing the force acting in direction B.

The control device 30 automatically prevents the lateral drift of the abrasive belt 10 and maintains the belt 10 in a fixed lateral position as described above. This minimizes the need for the bothersome adjustments as required in conventional belt sanders following each belt replacement, thereby enhancing the operability of the machine.

Various modifications of the control device 30 are possible within the scope of the invention. For example, the base 32 may be made slidable on the rear plate 31 in the lateral direction as seen in FIG. 6 relative to the rear plate 31 so that the position of the abutment plate 35 may be adjustable. Also, the roller 37 may be replaced with a ball or some other suitable member.

Furthermore, the entire control device 30, including the base 23, may be mounted on the side wall 2*a*.

Embodiment 3

Another preferred embodiment of the present invention will be explained hereinafter. Like reference characters designate like or corresponding parts throughout the drawings, so that the description thereof is hereby dispensed with.

Figure 7:
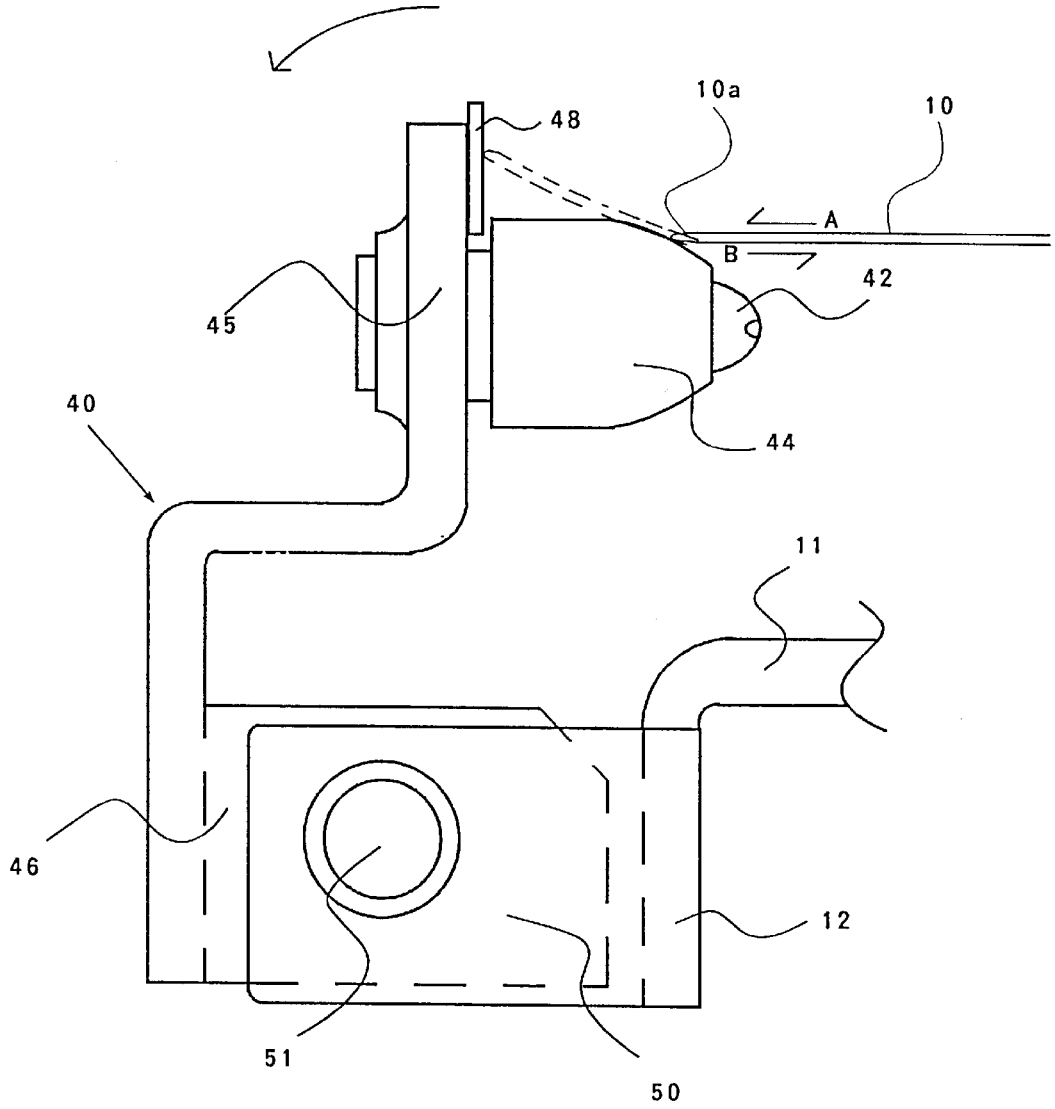
FIG. 7 is an elevation of a control device of still another embodiment in accordance with the present invention.

With reference to FIG. 7, numeral 40 generally designates a control device provided on the support plate 11. The control device 40 comprises a pivotal arm 45 made by twice bending a flat plate at right angles. A first connector lug 46 is connected to one end of the pivotal arm 45 while a tapered roller 44 is rotatably attached to the other end with a shoulder screw 42. The pivotal arm 45 also has a rectangular ceramic plate 48 attached thereto above the tapered roller 44. The device 40 is pivotally connected via a pivot 45 to a second connector lug 50 which is attached to one end of the left support arm 12. When the control device 40 is mounted, the inner surface of the upper portion of the pivotal arm 45 is arranged parallel to the rotational direction of the abrasive belt 10 as shown in FIG. 7. Also, the control device 40 is normally tilted to the right due to the location of its center of gravity, thus bringing the top end of the tapered roller 44 into contact with the left edge 10*a*.

When, in operation, the abrasive belt 10 rotates without drifting laterally, the edge 10*a* remains in contact with the top end of the tapered roller 44. When the abrasive belt 10 drifts toward the left as indicated by the broken line, however, the edge 10*a* abuts against the ceramic plate 48 and outwardly pushes the pivotal arm 45, thus rotating the arm 45 counterclockwise as indicated by the curved arrow over the arm 45. Simultaneously, the tapered roller 44 is tilted upward and in the counterclockwise direction, pushing up the edge 10*a* in the direction of the top surface of the belt 10. As explained above, this creates a force that moves the belt 10 back in direction B. As the belt 10 is moved back in direction B by this force, the control device 40 returns to its normal position.

In this way, the control device 40 automatically prevents the lateral drift of the abrasive belt 10 and maintains the belt 10 in a fixed lateral position. This minimizes the need for the bothersome adjustments as required in conventional belt sanders following each belt replacement, thereby enhancing the operability of the machine.

The control devices 20, 30, and 40 of the present invention should be positioned close to the tangential point where the belt 10 is still free of, but about to be rolled over either the driven or the driving roller. In fact, the closer the devices are located to either roller, the more effective they are. This is because as the contact point of the control device comes closer to the roller, both the angle $\alpha$ shown in FIG. 4 and the force acting in direction B become greater. To obtain the same effect, therefore, any of the control devices 20, 30, and 40 may be mounted in the side wall 2*a*, if possible, at a point where one is positioned closely to the driving roller 6 alongside the lower passage of the belt 10.

In the foregoing embodiments, the driven roller 8 is inclined to cause the abrasive belt 10 to travel toward a single control device 20, 30, or 40. Instead, two units of any of the control devices may be provided on either side of the belt 10, one unit as shown in FIGS. 1 and 5 and the other close to the driving roller 6 along the lower passage of the belt 10 as explained above. This will automatically correct the drift of the abrasive belt 10 in either lateral direction, thus eliminating the need for the initial inclination of the driven roller 8.

As there may be many other modifications, alterations, and changes without departing from the scope or spirit of the essential characteristics of the present invention, it is to be understood that the above embodiment is only an illustration and not restrictive in any sense. The scope or spirit of the present invention is limited only by the terms of the appended claims.

What is claimed is:

1. A belt sander comprising a driving roller and a driven roller, an endless abrasive belt trained over the driving roller and the driven roller, the belt being disposed along a normal path and having an underside, a top surface, a centerline, and an edge, a motor for rotatably driving the driving roller, and belt biasing means responsive to drift of the abrasive belt away from the normal path in a direction lateral to the centerline, the belt biasing means being disposed adjacent to the edge of the abrasive belt at a point at which the belt is free of a roller and coming into contact with the underside of the abrasive belt close to the edge, thereby biasing the edge of the abrasive belt in a direction orthogonal to the top surface of and away from the underside of the abrasive belt.

2. A belt sander in accordance with claim 1, wherein the belt biasing means comprises a slide contact member extending along a line forming an oblique angle relative to the top surface of the abrasive belt in a direction away from the centerline of the abrasive belt, whereby the edge of the abrasive belt comes into contact with the slide contact member when the abrasive belt drifts in a direction lateral to the normal path.

3. A belt sander in accordance with claim 2, wherein the slide contact member comprises a generally conical, tapered portion.

4. A belt sander in accordance with either claim 2 or 3, wherein the belt biasing means further comprises a means for adjusting the position of the slide contact member relative to the abrasive belt.

5. A belt sander in accordance with claim 4, wherein the adjusting means comprises a bolt and a nut engaged with the bolt for advancing and retracting the slide contact member relative to the abrasive belt.

6. A belt sander in accordance with claim 5 wherein the belt biasing means is positioned at a point at which the abrasive belt is free of a roller selected from a group consisting of the driven roller and the driving roller.

7. A belt sander in accordance with claim 5 wherein the driving roller is closer to the belt biasing means than the driven roller, the belt sander further comprising a means for laterally inclining the driving roller so as to cause the abrasive belt to drift away from the normal path in a direction lateral to the centerline.

8. A belt sander in accordance with claim 5 wherein the driven roller is closer to the belt biasing means than the driving roller, the belt sander further comprising a means for laterally inclining the driven roller so as to cause the abrasive belt to drift away from the normal path in a direction lateral to the centerline.

9. A belt sander in accordance with claim 1, wherein the belt biasing means comprises a pivoting member rotatably supported at an intermediate portion thereof, the pivoting member having a first end, a second end opposite the first end, an abutment portion, mounted on the first end, for rotating toward the underside of the abrasive belt when the edge of the laterally drifting belt abuts the abutment portion, and a push-up portion, mounted on the second end, for rotating toward the top surface of the abrasive belt and biasing the abrasive belt, the push-up portion being responsive to the rotation of the abutment portion toward the underside of the abrasive belt.

10. A belt sander in accordance with claim 9, wherein the push-up portion includes a rotatable member for coming into contact with the underside of the abrasive belt and rotating in the same direction as the abrasive belt when the abutment portion rotates toward the underside of the belt.

11. A belt sander in accordance with claim 10, wherein the rotatable member is selected from a group consisting of a roller, a ball, and a generally conical, tapered roller.

12. A belt sander in accordance with claim 1, wherein the belt biasing means comprises an arm pivotally supported on a first end thereof, the arm having a second end with an abutment portion mounted thereon against which the abrasive belt abuts when drifting away from the normal path in a direction lateral to the centerline, and an initial contact member, the initial contact member being positioned to be in contact with the edge of the abrasive belt when the abrasive belt is in the normal position, whereby the arm pivots outward upon abutment of the edge of the abrasive belt against the abutment portion, thus bringing the initial contact member into contact with the underside of the abrasive belt.

13. A belt sander in accordance with claim 12, wherein the initial contact member comprises a generally conical, tapered portion.

14. A belt sander in accordance with any one of claims 1–3 and 9–13 wherein the driving roller is closer to the belt biasing means than the driven roller and the belt sander further comprises a means for laterally inclining the driving roller to cause the abrasive belt to drift away from the normal path in a direction lateral to the centerline.

15. A belt sander in accordance with any one of claims 1–3 and 9–13 wherein the driven roller is closer to the belt biasing means than the driving roller, the belt sander further comprising a means for laterally inclining the driven roller to the belt biasing means so as to cause the abrasive belt to drift away from the normal path in a direction lateral to the centerline.

16. A belt sander comprising a driving roller and a driven roller, an endless abrasive belt trained over the driving roller and the driven roller, the belt being disposed along a normal path and having an underside, a top surface, a centerline, and an edge, a motor for rotatably driving the driving roller, and a belt biasing mechanism responsive to drift of the abrasive belt lateral to the normal path, the belt biasing mechanism being disposed adjacent to the edge of the abrasive belt at a point at which the belt is free of a roller and coming into contact with the underside of the abrasive belt close to the edge, thereby biasing the edge of the abrasive belt in a direction orthogonal to the top surface of and away from the underside of the abrasive belt.

17. A belt sander comprising a driving roller, a driven roller, and a motor for rotatably driving the driving roller, an endless abrasive belt driven by the driving roller and trained over the driving roller and the driven roller, the belt being disposed along a normal path and having an underside, a top surface and a centerline, a belt biasing means responsive to drift away from the normal path in a direction lateral to the centerline of the abrasive belt, the belt biasing means being disposed adjacent to an edge of the abrasive belt and coming into contact with the underside of the abrasive belt close to the edge, thereby biasing the edge of the abrasive belt in a direction orthogonal to the top surface of and away from the underside of the abrasive belt, wherein the belt biasing means includes a pivoting member rotatably supported in an intermediate portion thereof, the pivoting member having a first end, a second end opposite the first end, an abutment portion, mounted on the first end, for rotating toward the underside of the abrasive belt when the edge of the laterally drifting belt abuts the abutment portion, and a push-up portion, mounted on the second end, for rotating toward the top surface of the abrasive belt and biasing the abrasive belt, the push-up portion being responsive to the rotation of the abutment portion toward the underside of the abrasive belt.

18. A belt sander in accordance with claim 17, wherein the push-up portion includes a rotatable member disposed for coming into contact with the underside of the abrasive belt and rotating in the same direction as the abrasive belt when the abutment portion rotates toward the underside of the belt.

19. A belt sander in accordance with claim 18, wherein the rotatable member is selected from a group consisting of a roller, a ball, and a generally conical, tapered roller.

20. A belt sander comprising a driving roller and a driven roller, an endless abrasive belt trained over the driving roller and the driven roller, the belt being disposed along a normal path and having an underside, a top surface and a centerline, a motor for rotatably driving the driving roller and the abrasive belt, and a belt biasing means responsive to drift of the abrasive belt from the normal path in a direction lateral to the centerline, the belt biasing means being disposed adjacent to an edge of the abrasive belt and coming into contact with the underside of the abrasive belt close to the edge, thereby biasing the edge of the abrasive belt in a direction orthogonal to the top surface of and away from the underside of the abrasive belt, wherein the belt biasing means includes an arm pivotally supported on a first end thereof, the arm having a second end with an abutment portion mounted thereon against which the abrasive belt abuts when drifting laterally, and an initial contact member, the initial contact member being so positioned as to be in contact with the edge of the abrasive belt when the abrasive belt is positioned along the normal path, whereby the arm pivots outward upon abutment of the edge of the abrasive belt against the abutment portion, thus bringing the initial contact member into contact with the underside of the abrasive belt.

21. A belt sander in accordance with claim 20, wherein the initial contact member comprises a generally conical, tapered portion.

22. A belt sander in accordance with any one of claims 17–21, wherein the belt biasing means is positioned at a point at which the abrasive belt is free of a roller.

23. A belt sander in accordance with any one of claims 17–21 wherein the driving roller is closer to the belt biasing means than the driven roller, the belt sander further comprising a means for laterally inclining the driving roller to the belt biasing means so as to cause the abrasive belt to drift laterally.

24. A belt sander comprising a driving roller, a driven roller, and a motor for rotatably driving the driving roller an endless abrasive belt trained over the driving roller and the driven roller and driven by the driving roller, the belt having an underside, a top surface and a centerline, a belt biasing mechanism responsive to drift in a direction lateral to the centerline of the abrasive belt, the belt biasing mechanism being disposed adjacent to an edge of the abrasive belt and coming into contact with the underside of the abrasive belt close to the edge, thereby biasing the edge of the abrasive belt in a direction orthogonal to the top surface of and away from the underside of the abrasive belt, wherein the belt biasing mechanism includes a pivoting member rotatably supported in an intermediate portion thereof, the pivoting member having a first end, a second end opposite the first end, an abutment portion, mounted on the first end, for rotating toward the underside of the abrasive belt when the edge of the laterally drifting belt abuts the abutment portion, and a push-up portion, mounted on the second end, for rotating toward the top surface of the abrasive belt and biasing the abrasive belt, the push-up portion being responsive to the rotation of the abutment portion toward the underside of the abrasive belt.

25. A belt sander comprising a driving roller and a driven roller, an endless abrasive belt trained over the driving roller and the driven roller, the belt having an underside, a top surface, and a centerline, a motor for rotatably driving the driving roller and the abrasive belt, and a belt biasing mechanism responsive to the drift of the abrasive belt in a direction lateral to the centerline, the belt biasing mechanism being disposed adjacent to an edge of the abrasive belt and coming into contact with the underside of the abrasive belt close to the edge, thereby biasing the edge of the abrasive belt in a direction orthogonal to the top surface of and away from the underside of the abrasive belt, wherein the belt biasing mechanism includes an arm pivotally supported on a first end thereof, the arm having a second end with an abutment portion mounted thereon against which the abrasive belt abuts when drifting laterally, and an initial contact member, the initial contact member being so positioned as to be in contact with the edge of the abrasive belt when the abrasive belt is in a normal position, whereby the arm pivots outward upon abutment of the edge of the abrasive belt against the abutment portion, thus bringing the initial contact member into contact with the underside of the abrasive belt.

* * * * *